US008443892B2

(12) United States Patent
Richard et al.

(10) Patent No.: US 8,443,892 B2
(45) **Date of Patent: *May 21, 2013**

(54) FRACTURING WITH TELESCOPING MEMBERS AND SEALING THE ANNULAR SPACE

(75) Inventors: Bennett M. Richard, Kingwood, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 61 days.

This patent is subject to a terminal disclaimer.

(21) Appl. No.: 13/356,402

(22) Filed: Jan. 23, 2012

(65) Prior Publication Data

US 2012/0118573 A1 May 17, 2012

Related U.S. Application Data

(63) Continuation of application No. 12/463,944, filed on May 11, 2009, now Pat. No. 8,104,538.

(51) Int. Cl.
*E21B 43/26* (2006.01)

(52) U.S. Cl.
USPC ..... 166/308.1; 166/50; 166/177.5; 166/191; 166/373; 166/374; 166/376; 166/386; 166/387

(58) Field of Classification Search
None
See application file for complete search history.

(56) References Cited

U.S. PATENT DOCUMENTS

| | | | | |
|---|---|---|---|---|
| 3,347,317 | A | 10/1967 | Zandmer | |
| 4,475,729 | A | 10/1984 | Costigan | |
| 5,425,424 | A | 6/1995 | Reinhardt et al. | |
| 7,267,172 | B2 | 9/2007 | Hofman | |
| 7,387,158 | B2 | 6/2008 | Murray et al. | |
| 7,387,165 | B2 | 6/2008 | Lopez de Cardenas et al. | |
| 7,392,841 | B2 | 7/2008 | Murray et al. | |
| 7,422,058 | B2 | 9/2008 | O'Malley | |
| 7,422,069 | B2 | 9/2008 | Richard et al. | |
| 7,441,596 | B2 | 10/2008 | Wood et al. | |
| 7,475,729 | B2 | 1/2009 | Johnson | |
| 8,104,538 | B2 * | 1/2012 | Richard et al. | 166/308.1 |
| 2004/0079535 | A1 | 4/2004 | Richard et al. | |
| 2006/0048939 | A1 | 3/2006 | Johnson | |
| 2006/0124310 | A1 | 6/2006 | Lopez de Cardenas et al. | |
| 2008/0035349 | A1 | 2/2008 | Richard | |
| 2008/0121390 | A1 | 5/2008 | O'Malley et al. | |
| 2010/0263871 | A1 * | 10/2010 | Xu et al. | 166/308.1 |

OTHER PUBLICATIONS

Hill, Leo E., et al., "Completion Tools Proven Successful in Deepwater Frac Packs and Horizontal Gravel-Packing", IADC/SPE 74492, Feb. 2002, 1-15.

(Continued)

*Primary Examiner* — George Suchfield

(74) *Attorney, Agent, or Firm* — Steve Rosenblatt

(57) ABSTRACT

A fracturing operation is done in open hole. The annular space is spanned by telescoping members that are located behind isolation valves. A given bank of telescoping members can be uncovered and the telescoping members extended to span the annular space and engage the formation in a sealing manner. Pressurized fracturing fluid can be pumped through the telescoped passages and the portion of the desired formation fractured. In a proper formation, cementing is not needed to maintain wellbore integrity. In formations that need annular space isolation, the string in a preferred embodiment can have an external material that grows to seal the annular space in lieu of a traditional cementing operation.

31 Claims, 5 Drawing Sheets

OTHER PUBLICATIONS

Coronado, Martin P., et al., "Development of a One-Trip ECP Cement Inflation and Stage Cementing System for Open Hole Completions", IADC/SPE 39345, Mar. 1998, 473-481.

Henriksen, K.H., et al., "Integration of New Open Hole Zonal Isolation Technology Contributes to Improved Reserve Recovery and Revision in Industry Best Practices", SPE 97614, Dec. 2005, 1-6.

Garfield, G., et al., "Novel Completion Technology Eliminates Formation Damage and Reduced Rig Time in Sand Control Applications," SPE 93518, Mar. 2005, pp. 1-5.

Garfield, G., "New One-Trip Sand-Control Completion System That Eliminates Formation Damage Resulting From Conventional Perforating and Gravel-Packing Operations," SPE 96660, Oct. 2005, pp. 1-5.

McElfresh, P., et al., "Maximizing Inflow Performance in Soft Sand Completions Using New One-Trip Sand Control Liner Completion Technology," SPE 94622, May 2005, pp. 1-5.

* cited by examiner

FRACTURING WITH TELESCOPING MEMBERS AND SEALING THE ANNULAR SPACE

PRIORITY INFORMATION

This application is a continuation of U.S. patent application Ser. No. 12/463,944 filed on May 11, 2009.

FIELD OF THE INVENTION

The field of the invention is fracturing and more particularly a method for fracturing in open hole without external zone isolators and more particularly with an ability to seal the annulus without a traditional cementing job.

BACKGROUND OF THE INVENTION

There are two commonly used techniques to fracture in a completion method. FIG. 1 shows a borehole 10 that has a casing string 12 that is cemented 14 in the surrounding annulus 16. This is normally done through a cementing shoe (not shown) at the lower end of the casing string 12. In many cases if further drilling is contemplated, the shoe is milled out and further drilling progresses. After the string 12 is cemented and the cement 14 sets a perforating gun (not shown is run in and fired to make perforations 18 that are then fractured with fluid delivered from the surface followed by installation and setting of packer or bridge plug 20 to isolate perforations 18. After that the process is repeated where the gun perforates followed by fracturing and followed by setting yet another packer or bridge plug above the recently made and fractured perforations. In sequence, perforation and packer/bridge plug pairs 22, 24; 26, 28; 30, 32; and 34 are put in place in the well 10 working from the bottom 36 toward the well surface 38.

A variation of this scheme is to eliminate the perforation by putting into the casing wall telescoping members that can be selectively extended through the cement before the cement sets to create passages into the formation and to bridge the cemented annulus. The use of extendable members to replace the perforation process is illustrated in U.S. Pat. No. 4,475,729. Once the members are extended, the annulus is cemented and the filtered passages are opened through the extending members so that in this particular case the well can be used in injection service. While the perforating is eliminated with the extendable members the cost of a cementing job plus rig time can be very high and in some locations the logistical complications of the well site can add to the cost.

More recently, external packers that swell in well fluids or that otherwise can be set such as 40, 42, 44, 46, and 48 in FIG. 2 can be set on the exterior of the string 49 to isolate zones 50, 52, 54, and 56 where there is a valve, typically a sliding sleeve 58, 60, 62 and 64 in the respective zones. The string 49 is hung off the casing 66 and is capped at its lower end 67. Using a variety of known devices for shifting the sleeves, they can be opened in any desired order so that the annular spaces 68, 70, 72 and 74 can be isolated between two packers so that pressurized frac fluid can be delivered into the annular space and still direct pressure into the surrounding formation. This method of fracturing involves proper packer placement when making up the string and delays to allow the packers to swell to isolate the zones. There are also potential uncertainties as to whether all the packers have attained a seal so that the developed pressure in the string is reliably going to the intended zone with the pressure delivered into the string 49 at the surface. Some examples of swelling packer are U.S. Pat. Nos. 7,441,596; 7,392,841 and 7,387,158.

In some instances the telescoping members have been combined with surrounding sleeves of a swelling material to better seal the extended ends of the telescoping members to the formation while still leaving open the remainder of the annular space to the formation in a given zone. Some examples of this design are U.S. Pat. No. 7,387,165 and U.S. Pat. No. 7,422,058. US Publication 2008/0121390 shows a spiral projection that can swell and/or be expanded into wellbore contact and leave passageways in between the projections for delivery of cement.

What is needed and provided by the method of the present invention is a technique to pinpoint the applied frac pressure to the desired formation while dispensing with expensive procedures such as cementing and annulus packers where the formation characteristics are such as that the hole will retain its integrity. The pressure in the string is delivered through extendable conduits that go into the formation. Given banks of conduits are coupled with an isolation device so that only the bank or banks in interest that are to be fractured at any given time are selectively open. The delivered pressure through the extended conduits goes right to the formation and bypasses the annular space in between. Beyond that the string exterior can have a covering of a swelling material such as rubber or a shape memory polymer, either of which can fill the annular gap and replace the traditional and expensive cement job. Those and other features of the present invention will be more readily understood to those skilled in the art from a review of the description of the preferred embodiment and the associated FIGS. 3-10 while understanding that the full scope of the invention is determined by the literal and equivalent scope of the appended claims.

SUMMARY OF THE INVENTION

A fracturing operation is done in open hole. The annular space is spanned by telescoping members that are located behind isolation valves. A given bank of telescoping members can be uncovered and the telescoping members extended to span the annular space and engage the formation in a sealing manner. Pressurized fracturing fluid can be pumped through the telescoped passages and the portion of the desired formation fractured. In a proper formation, cementing is not needed to maintain wellbore integrity. The telescoping members can optionally have screens. Normally, the nature of the formation is such that gravel packing is also not required. A production string can be inserted into the string with the telescoping devices and the formation portions of interest can be produced through the selectively exposed telescoping members. In formations that need annular space isolation, the string in a preferred embodiment can have an external material that grows to seal the annular space in lieu of a traditional cementing operation.

DETAILED DESCRIPTION OF THE PREFERRED EMBODIMENT

Figure 3:
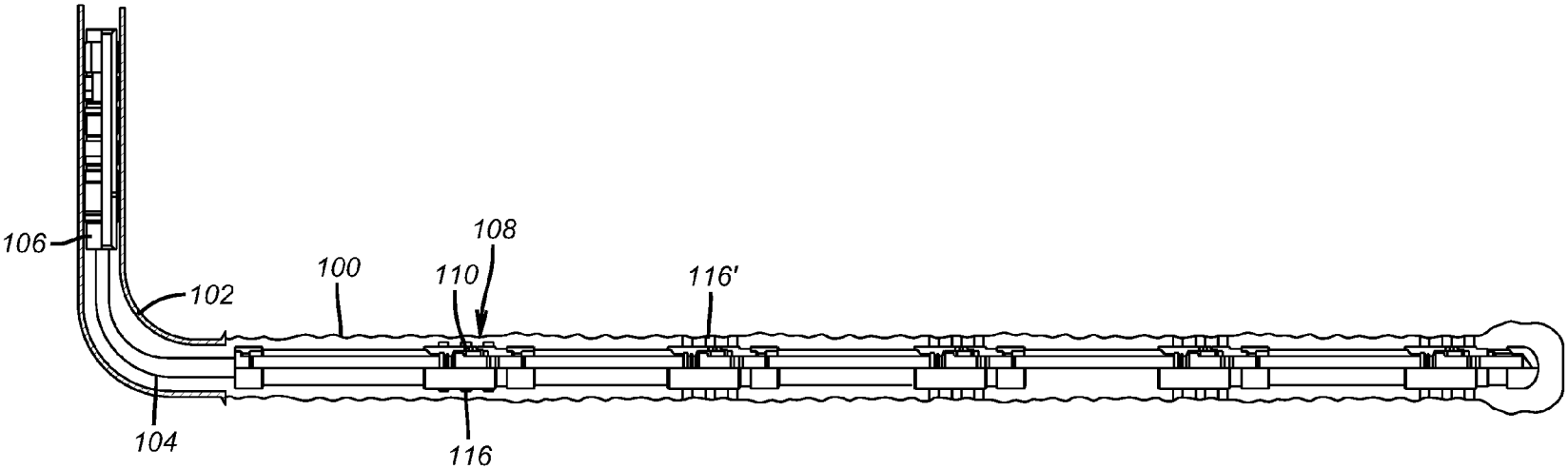
FIG. 3 shows the method of the present invention using extendable passages into the formation that are selectively accessed with a valve so that the formation can be fractured directly from the string while bypassing the annular open hole space.

FIG. 3 illustrates one embodiment of the invention where the formation has the characteristics that make annular space isolation between the assemblies 108 optional. The preferred embodiment with annular space isolation is shown in FIGS. 7-10.

Figure 4:
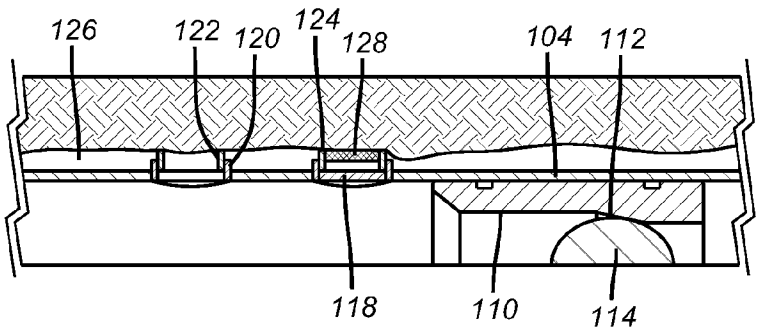
FIG. 4 is a detailed view of a telescoping passage in the extended position.

FIG. 3 illustrates an open hole 100 below a casing 102. A liner 104 is hung off casing 102 using a liner hanger 106. A fracturing assembly 108 is typical of the others illustrated in the FIG. 3 and those skilled in the art will appreciate that any number of assemblies 108 can be used which are for the most part similar but can be varied to accommodate actuation in a desired sequence as will be explained below. As shown in FIG. 4 each assembly 108 has a closure device that is preferably a sliding sleeve 110 that can be optionally operable with a ball 114 landing on a seat 112. In one embodiment, the seats and balls that land on them are all different sizes and the sleeves can be closed in a bottom up sequence by first landing smaller balls on smaller seats that are on the lower assemblies 108 and progressively dropping larger balls that will land on different seats to close the valve 110.

The array of telescoping members 116 selectively covered by a valve 110 can be in any number or array or size as needed in the application for the expected flow rates for fracturing or subsequent production. The telescoping assembly 116 is shown in the retracted position in FIG. 3 while telescoping members 116' are shown in the same FIG. 3 in the extended position against the borehole wall 100. In the preferred embodiment all the telescoping assemblies 116 are initially obstructed with a plug 118 so that internal pressure in the liner 104 will result in telescoping extension between or among members in each assembly, such as 120 and 122 or however many relatively moving segments are needed depending on the width of the annular gap that has to be crossed to get the leading ends 124 into the formation so that directed pressure will penetrate the formation and not go into the open annulus 126. The plugs 118 are there to allow all the assemblies 116 to extend in response to the valves 110 at each assembly 116 being open and pressure applied inside the liner 104. Once all the telescoping assemblies are extended, the plugs 118 in each can be removed. This can be done in many ways but one way is to use plugs that can disappear such as aluminum alloy plugs that will dissolve in an introduced fluid. Each or some of the assemblies can have a screen material 128 in the through passage that forms after extension and after removal of the plug 118.

The valve 110 associated with each telescoping assembly 116 can also be operated with a sleeve shifter tool in any desired order. Each valve can have a unique profile that can be engaged by a shifting tool on the same or in separate trips to expedite the fracturing with one valve 110 and its associated telescoping array 116 ready for fracturing or more than one valve 110 and telescoping array 116.

As another alternative for closing the valve 110 articulated ball seats can be used that accept a ball of a given diameter and allow the valve 110 to be operated and the ball to pass after moving the seat where such seat movement configures a another seat in another valve 110 to form to accept another object that has the same diameter as the first dropped object and yet operate a different valve 110. Other techniques can be used to allow more than one valve to be operated in a single trip in the well. For example an articulated shifting tool can be run in and actuated so that on the way out or into the well it can open or close one or more than one valve either based on unique engagement profiles at each valve, which is preferably a sliding sleeve or even with common shifting profiles using the known location of each valve and shifting tool actuation before reaching a specific valve that needs shifting.

Alternatively rupture discs set to break at different pressure ratings can be used to sequence which telescoping passages will open at a given pressure and in a particular sequence. However, once a rupture disc is broken to open flow through a bank of telescoping passages, those passages cannot be closed again when another set of discs are broken for access to another zone. With sliding sleeves all the available volume and pressure can be directed to a predetermined bank of passages but with rupture discs there is less versatility if particular zones are to be fractured in isolation.

Figure 1:
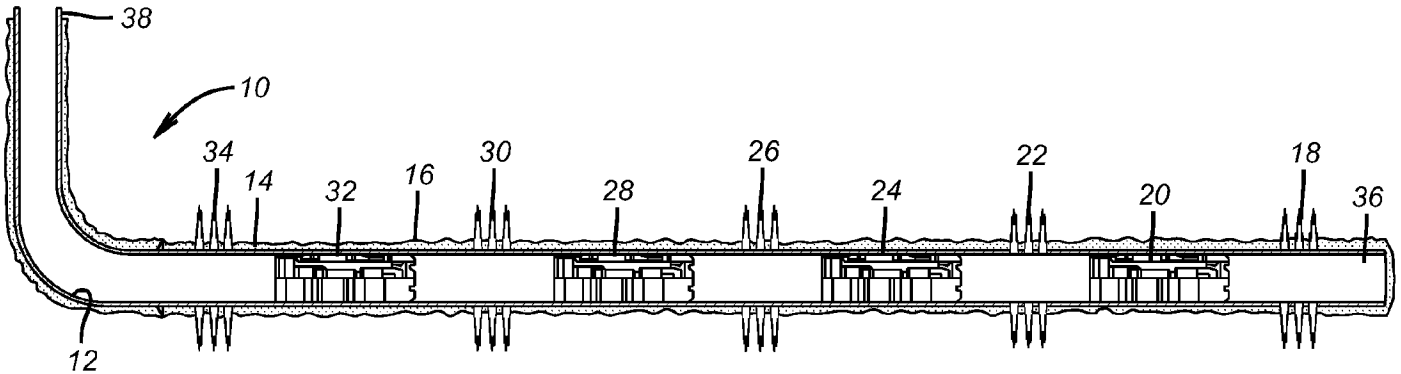
(PRIOR ART) FIG. 1
FIG. 1 is a prior art system of cementing a casing and sequentially perforating and setting internal packers or bridge plugs to isolate the zones as they are perforated and fractured.
Figure 2:
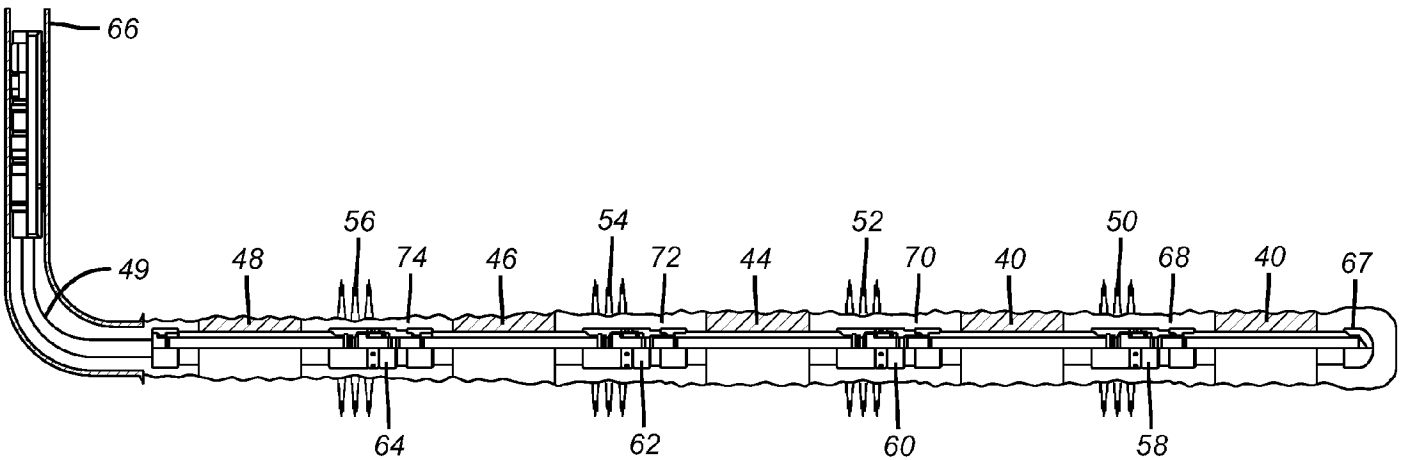
(PRIOR ART) FIG. 2
FIG. 2 is another prior art system using external swelling packers in the annular space to isolate zones that are accessible with a sliding sleeve valve.

The above method of the present invention allows fracturing in open hole with direction of the fracture fluid into the formation without the need for annular barriers and in a proper formation the fracturing can take place in open hole without cementing the liner. Such a technique in combination with valves at most or all of the telescoping assemblies allows the fracturing to pin done in the needed locations and in the desired order. After fracturing, some or all the valves can be closed to either shut in the whole well where fracturing took place or to selectively open one or more locations for production through the liner and into a production string (not shown). The resulting method described above saves the cost of cementing and the cost of annulus barriers and allows the entire process to the point of the fracturing job to be done in less time than the prior methods such as those described in FIGS. 1 and 2.

While telescoping assemblies are discussed as the preferred embodiment other designs are envisioned that can effectively span the gap of the surrounding annulus in a manner to engage the formation in a manner that facilitates pressure transmission and reduces pressure or fluid loss into the surrounding annulus. Those skilled in the art will appreciate that the above described method is focused on well consolidated formations where hole collapse is not a significant issue. In other applications, described below, the bottom hole assembly will also feature a swelling material or a shape memory polymer to fill the surrounding annular space 126 described above and left open in the above described embodiment.

Figure 5A:
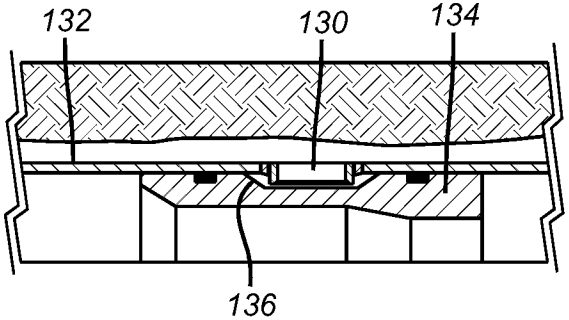
FIGS. 5*a* and 5*b* show a telescoping member extended with a sliding sleeve and opened for formation access at the same time.
Figure 5B:
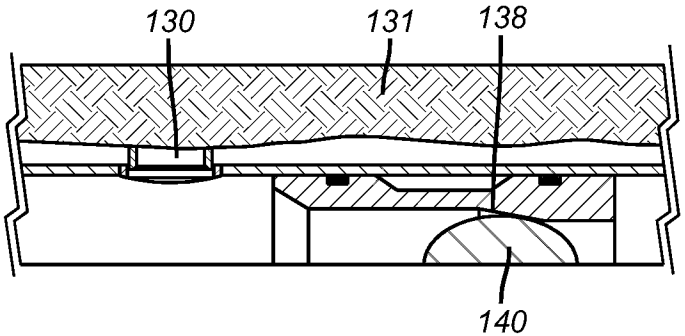

One alternative to extending the assemblies 116 hydraulically is to do it mechanically. As shown as 130 in FIG. 5, the telescoping units are retracted into the casing so as not to extend beyond its outside diameter 132 when installed. When sliding sleeve 134 shifts in FIG. 5*b*, such as when ball 138 lands on seat 140 the sliding sleeve 134 has a taper 136 which applies mechanical force onto the telescoping units 130 and extends them to touch the formation as shown as 131.

Figure 6A:
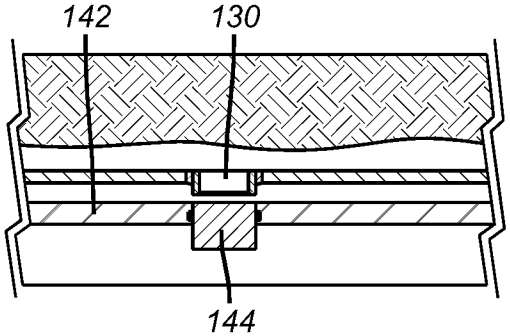
FIGS. 6*a* and 6*b* show a running string with extendable devices for extending the telescoping passages to the formation.
Figure 6B:
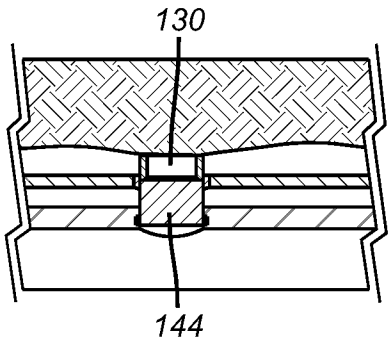

Although a sliding sleeve is preferred, any mechanical devices can be used to mechanically extend the telescoping units. One example, shown in FIGS. 6*a* and 6*b*, is to use a running string 142 with collapsible pushers 144 to push out the telescoping units as shown in FIGS. 6*a* and 6*b*. The pushers can be extended with internal pressure or by another means. In this case, a closure device is optional.

Another alternative to pushing out the assemblies 116 with pressure using telescoping components is to incorporate expansion of the liner 104 to get the assemblies to the surrounding formation. This can be with a combination of a telescoping assembly coupled with tubular expansion. The expansion of the liner can be with a swage whose progress drives out the assemblies that can be internal to the liner 104 during run in. Alternatively, the expansion can be done with pressure that not only expands the liner but also extends the assemblies 116.

Optionally, the leading ends of the outermost telescoping segment 122 can be made hard and sharp such as with carbide or diamond inserts to assist in penetration into the formation as well as sealing against it. The leading end can be castellated or contain other patterns of points to aid in penetration into the formation.

Figure 7:
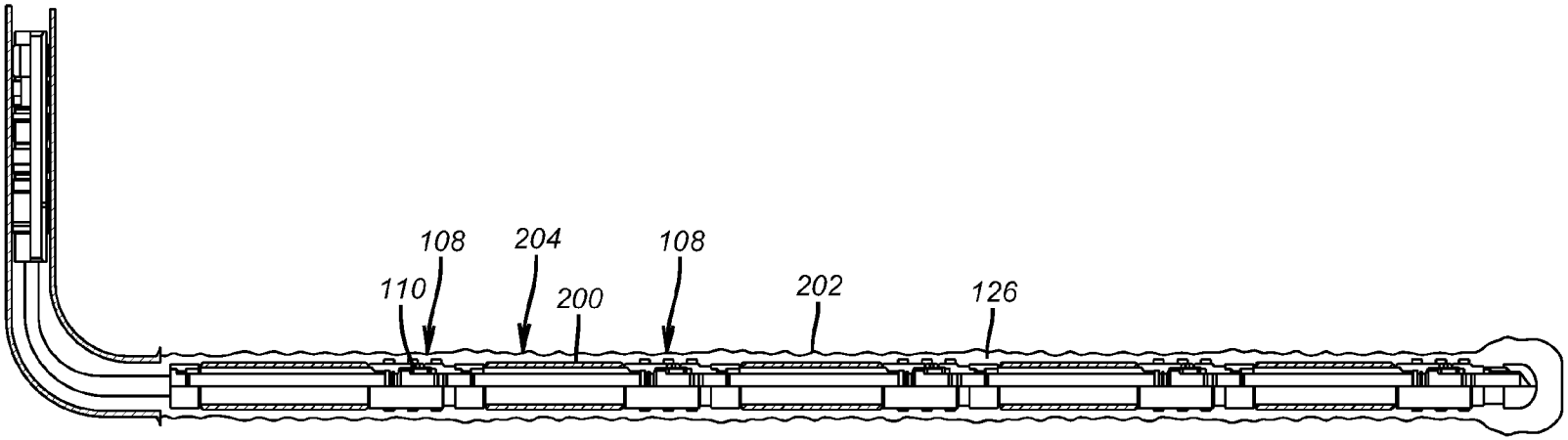
FIG. 7 is an embodiment showing the run in position of an assembly with sealing between the telescoping members that can seal the annulus in lieu of cementing.
Figure 8:
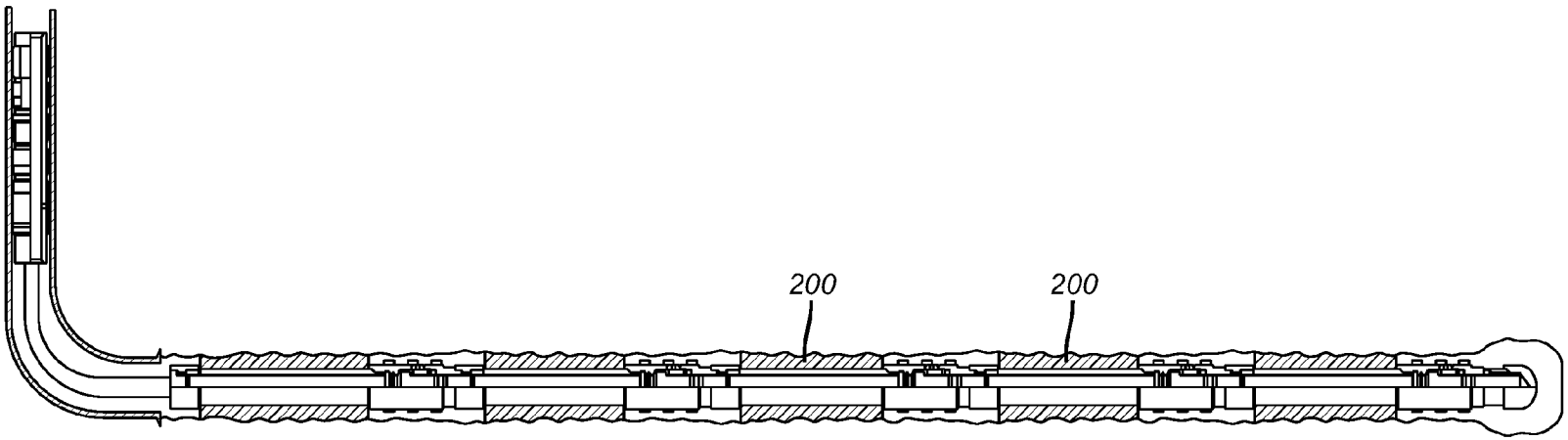
FIG. 8 is the view of FIG. 7 with the annulus sealed.

FIG. 7 is identical to FIG. 3 but with one major difference. There are still a plurality of spaced apart fracturing assemblies 108 that have valves 110 telescoping assemblies 116. In FIGS. 7-10 there are sealing members 200 that have a small dimension for run in as shown in FIG. 7 and that grow in the borehole 202 until they seal it off. The annular spaces 126 shown in FIG. 7 are closed off in FIG. 8 as the sealing members get larger preferably by swelling. The sealing members 200 can swell in the presence of well fluids such as hydrocarbons when they are made of rubber, for example. They can also incorporate a cover that delays the swelling to allow time to get the assembly into position in the wellbore. These covers can be dissolved by well fluids for example. The sealing members 200 can also be formed from a shape memory polymer that in the presence of well fluids or heat artificially added with a heater or by inducing a chemical reaction that is exothermic, for example and all schematically represented by arrow 204, will swell to seal the annular spaces 126. In this manner a very expensive cement job can be avoided. In formations where it is beneficial to seal the annular space apart from the access locations to the formation from assemblies 108, the use of the members 200 is an economical way to seal without the cost and logistical issues involved in a cementing job. This is an even more significant factor in offshore wells where the logistics of conducting a cementing job grow far more complex and therefore expensive.

Figure 9:
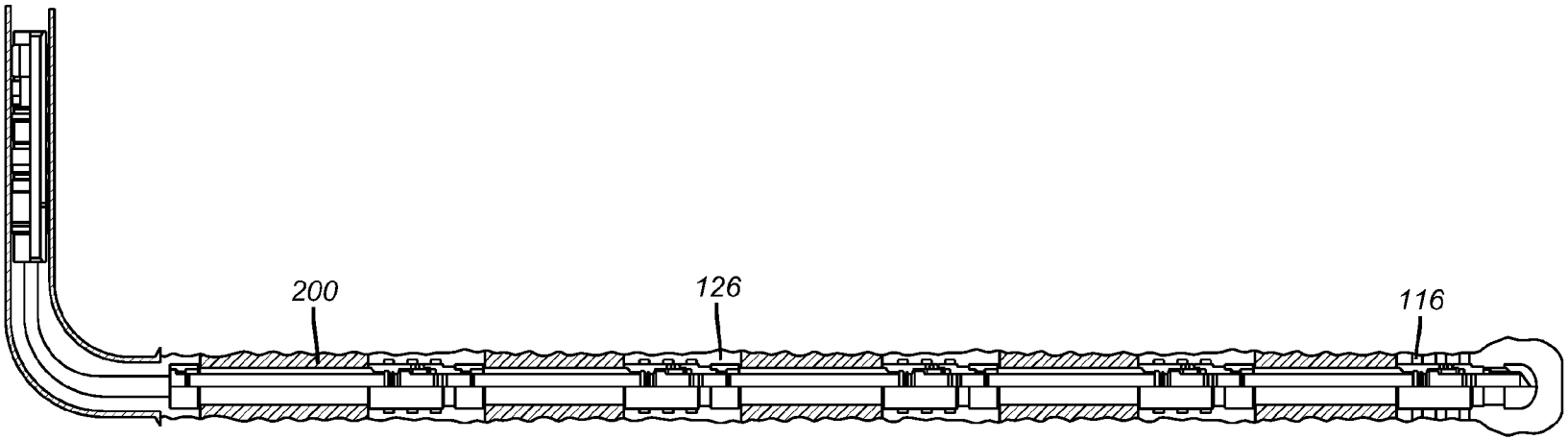
FIG. 9 is the view of FIG. 8 with a telescoping passage extended.
Figure 10:
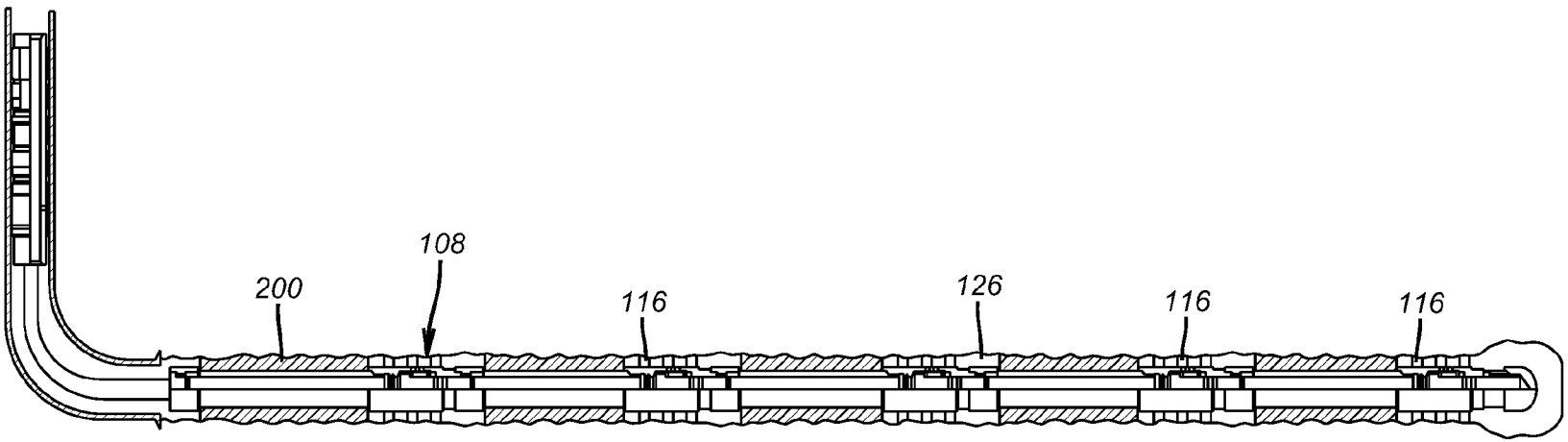
FIG. 10 is the view of FIG. 9 with all the telescoping passages extended.

FIG. 9 shows one set of the telescoping members 116 extended as the fracturing starts in the manner described above, while FIG. 10 illustrates all the telescoping assemblies 116 extended and the annular space 126 sealed by members 200 with breaks around the extended telescoping assemblies 116.

The above description is illustrative of the preferred embodiment and many modifications may be made by those skilled in the art without departing from the invention whose scope is to be determined from the literal and equivalent scope of the claims below:

We claim:

1. A formation fracturing method, comprising:

running a completion string that comprises a plurality of wall passages into open hole;

spanning an annulus around said string with at least some of said passages that engage the formation while leaving said annulus substantially open to the formation;

delivering pressurized fluid through at least one of said passages to fracture the formation;

lengthening or shifting said passages into contact with the formation by moving a valve member that initially covers said passage away from said passage.

2. The method of claim 1, comprising:

selectively closing access to at least one of said passages from within said string.

3. The method of claim 2, comprising:

using said valve member for said selectively closing access.

4. The method of claim 3, comprising:

providing a plurality of spaced sliding sleeves as said valve members for selectively opening or isolating a plurality of passages associated with each sliding sleeve.

5. The method of claim 4, comprising:

sequentially fracturing through a plurality of passages associated with at least two sliding sleeves, said sleeves selected to be sequentially open so that different groups of passages associated with different sliding sleeves can be used to fracture in any required order.

6. The method of claim 4, comprising:

keeping only one sliding sleeve open while delivering pressurized fluid to the passages associated with said open sliding sleeve.

7. The method of claim 6, comprising:

closing said open sliding sleeve and opening another sliding sleeve that is located uphole from the closed sliding sleeve;

sequentially closing and then opening sleeves in an uphole direction until pressurized fluid is delivered through all said passages.

8. The method of claim 6, comprising:

closing said open sliding sleeve and opening another sliding sleeve that is located downhole from the closed sliding sleeve;

sequentially closing and then opening sleeves in a downhole direction until pressurized fluid is delivered through all said passages.

9. The method of claim 6, comprising:

opening all said sliding sleeves and taking production through said passages.

10. The method of claim 4, comprising:

providing a sharp or hardened treatment on said leading end to facilitate said penetrating.

11. The method of claim 3, comprising:

sealing said annulus before or after said delivering with at least one seal supported by said completion string when said seal on said completion string is run into said open hole.

12. The method of claim 11, comprising:

making said seal enlarge to a sealing position from delivery into said open hole.

13. The method of claim 12, comprising:

making said seal enlarge by exposure to well fluids in said open hole.

14. The method of claim 13, comprising:

using the temperature of well fluids or heat artificially added in said open hole to enlarge said seal.

15. The method of claim 12, comprising:

using rubber or a shape memory polymer for said seal.

16. The method of claim 12, comprising:

using a plurality of spaced apart seals as said at least one seal where said spacing represents the location of said wall passages that engage the formation;

substantially sealing said annulus around said passages by swelling of said seals.

17. The method of claim 1, comprising:
lengthening or shifting said passages into contact with the formation.

18. The method of claim 17, comprising:
forming said passages from relative movable telescoping members.

19. The method of claim 18, comprising:
initially internally blocking said passages;
building pressure in said blocked passages to relatively move said telescoping members.

20. The method of claim 19, comprising:
removing the blockage from said passages after extending them into formation contact.

21. The method of claim 20, comprising:
dissolving or removing the blockage using a fluid in the well.

22. The method of claim 17, comprising:
engaging said passages with an extendable member on a second string run into said completion string to extend or shift said passages to the formation.

23. The method of claim 1, comprising:
mechanically or hydraulically extending or shifting said passages into sealing contact with the formation.

24. The method of claim 1, comprising:
expanding said string to shorten the distance said passages have to span to contact the formation.

25. The method of claim 24, comprising:
using a swage to expand said string.

26. The method of claim 24, comprising:
extending or shifting said passages by expanding said string.

27. The method of claim 24, comprising:
extending or shifting said passages independently of expansion of said string.

28. The method of claim 27, comprising:
expanding said string after fully extending or shifting said passages.

29. The method of claim 1, comprising:
spanning said annulus with all of said passages by extending or shifting them at about the same time.

30. The method of claim 1, comprising:
placing a leading end of said passages in sealing contact with the formation.

31. The method of claim 30, comprising:
penetrating the formation with said leading end.

* * * * *